US005795239A

United States Patent [19]

Lin

[11] Patent Number: 5,795,239

[45] Date of Patent: Aug. 18, 1998

[54] GOLF PUTTER

[76] Inventor: Chun Shin Lin, 6F, No. 8, Alley 33, Lane 114, Section 7, Chung-Shan N. Road, Tien-Shan Li, Shin Lin, Taipei, Taiwan

[21] Appl. No.: 818,916

[22] Filed: Mar. 17, 1997

[30] Foreign Application Priority Data

Aug. 28, 1996 [TW] Taiwan ..... 85213195

[51] Int. Cl.[6] ..... A63B 53/04

[52] U.S. Cl. ..... 473/255; 473/306; 473/313; 473/314; 473/330; 473/340; 473/337

[58] Field of Search ..... 473/255, 305, 473/306, 307, 308, 309, 310, 311, 312, 313, 314, 315, 341, 336, 337, 330, 340

[56] References Cited

U.S. PATENT DOCUMENTS

| | | | |
|---|---|---|---|
| 3,170,691 | 2/1965 | Pritchard | 473/306 |
| 3,692,306 | 9/1972 | Glover | 473/338 |
| 3,758,115 | 9/1973 | Hoglund | 473/255 |
| 4,138,117 | 2/1979 | Dalton et al. | 473/255 |
| 4,361,329 | 11/1982 | Brock | 473/343 |
| 4,413,825 | 11/1983 | Sasse | 473/331 |
| 4,964,639 | 10/1990 | Tucker | 473/255 |
| 5,029,864 | 7/1991 | Keener | 473/331 |
| 5,072,941 | 12/1991 | Klein et al. | 473/255 |
| 5,080,365 | 1/1992 | Winchell | 473/255 |
| 5,116,047 | 5/1992 | Phelan et al. | 473/307 |

*Primary Examiner*—Sebastiano Passaniti
*Attorney, Agent, or Firm*—Barnes & Thornburg

[57] ABSTRACT

A golf putter comprising a shaft, a elongate head detachably connected to the shaft and having an impact wing on a longitudinal end thereof and a counterweight adjust means on another longitudinal end thereof, and a connecting structure connecting the shaft and head, in which the head is provided with an impact face on a surface of the impact wing which is positioned in a perpendicular relationship with a lateral axis of the head; and the connecting structure includes a threaded portion formed at a lower end of the shaft and a first thread head formed in the head in a position perparticular to a lateral axis of the head for thread engagement with the threaded portion.

9 Claims, 4 Drawing Sheets

GOLF PUTTER

FIELD OF THE INVENTION

This invention relates to a golf putter, and more particularly to a golf putter which facilitates control of both putting direction as well as putting force.

BACKGROUND OF THE INVENTION

As shown in FIG. 1, a prior art golf putter 1 is comprised of a shaft 2 and a head 3, in which the shaft 2 is provided with a grip 2G on its top end and is affixed with its bottom end to the irregularly shaped head 3 by a hosel 4, and an impact face 3F being parallel to the central axis 3A of the head 3 is also formed on the head 3.

In order to accurately putt a ball, the gravity center 3G of the head 3 generally needs to be aligned to the center of the ball while enabling the central axis 3A of the head 3 to be perpendicular to the putting direction which is defined as the direction from the ball to be putted toward the hole on a putting green, so that the ball can be putted into the hole on the putting green via the putting direction with appropriate force.

Meanwhile, the grip 2G is typically formed with a base face 2F which is perpendicular to the impact face 3F. The base face 2F is adapted to provide a gripping basis for the player so that the impact face 3F can be kept in a perpendicular relationship with the putting direction while putting.

However, the head 3 is of an irregular shape which makes the gravity center 3G of the head 3 off the extension direction of the axis 2A of the shaft, it is therefore difficult to putt the ball precisely with the gravity center 3G but usually putt the ball with areas on the impact face 3F other than the gravity center 3G. As a result, the putting force against the ball is either too large or too small that causes the ball to either pass over the hole or stop before reaching the hole.

Besides, since the head 3 is not formed symmetrically with respect to the shaft 2, the gravity center 3G not located in the extension direction of the axis 2A of the shaft 2 will result in an inertia moment with respect to the axis 2A. The impact face 3F is therefore apt to be rotatable about the axis 2A by the inertia moment while putting. That is, a torque with respect to the axis 2A is generated because of the inertia moment, which tends to make the impact face 3F of the head 3 oblique when putting. Consequently, the central axis 3A of the head 3 is not easy to keep perpendicular to the putting direction, thereby the ball is accordingly putted in a direction away from the putting direction.

Additionally, the shaft 2 and the head 3 of the prior art putter 1 are fixedly joined together, such that the entire putter 1 will be out of use if either the shaft 2 or the head 3 is broken or damaged, even though the other part is still operational. This is not only a waste of resource, but also against the concepts of "reuse" and "recycle".

Furthermore, although the grip 2G is replaceable while being worn out, a new grip 2G may be mounted on the top end of the shaft 2 in a position that the base face 2F of grip 2G is not perpendicular to the impact face 3F. It thus causes a player difficult to enable the impact face 3F perpendicular to the putting direction and accordingly makes the player apt to putting a ball to run in a direction other than the correct putting direction.

SUMMARY OF THE INVENTION

Accordingly, it is an object of the present invention to provide a golf putter which brings about no inertia moment with respect to the axis of the shaft such that the impact face of the head can be easily kept perpendicular to the putting direction when in putting.

It is another object of the present invention to provide a golf putter that a golfer can easily putt the ball with the gravity center of the head and control the exertion of putting force.

It is yet another object of the present invention to provide a golf putter that the head and the shaft thereof can be easily assembled and disassembled such that the parts of the golf putter are replaceable when out of use.

It is still another object of the present invention to provide a golf putter that the length of the part of the shaft exposing out of the head is adjustable to meet golfers' needs in the total length of the golf putter.

It is yet another object of the present invention to provide a golf putter that a lengthwise sight is formed on the top of the head to assist a golf to easily align the head with the putting direction.

It is still another object of the present invention to provide a golf putter that the position of the head with respect to the shaft can be slightly adjusted so as to maintain the base face of the grip and the impact face of the head in perpendicular relationship.

According to the present invention, there is provided a golf putter comprising a shaft with a grip disposed on an upper end thereof, a laterally extended head detachable connected to a bottom end of the shaft and having an impact wing on one of the longitudinal ends thereof and a counterweight adjust means on the other end thereof, and a connecting means for connecting the shaft and the head, wherein the head is shaped symmetrically and regularly with respect to the lateral axis of the head and an impact face is formed on a surface of the impact wing which is managed to putt, and the connecting means consists of a threaded portion formed on the bottom end of the shaft and a first thread hole provided in the head through the longitudinal axis of the head for thread engagement with the threaded portion. Further, a second thread hole can be additionally formed in the head and positioned perpendicular to the lateral axis of the head. The second thread hole allows a threaded bolt to be screwed thereinto so as to firmly secure the shaft to the head.

DETAILED DESCRIPTION OF THE INVENTION

Figure 1:
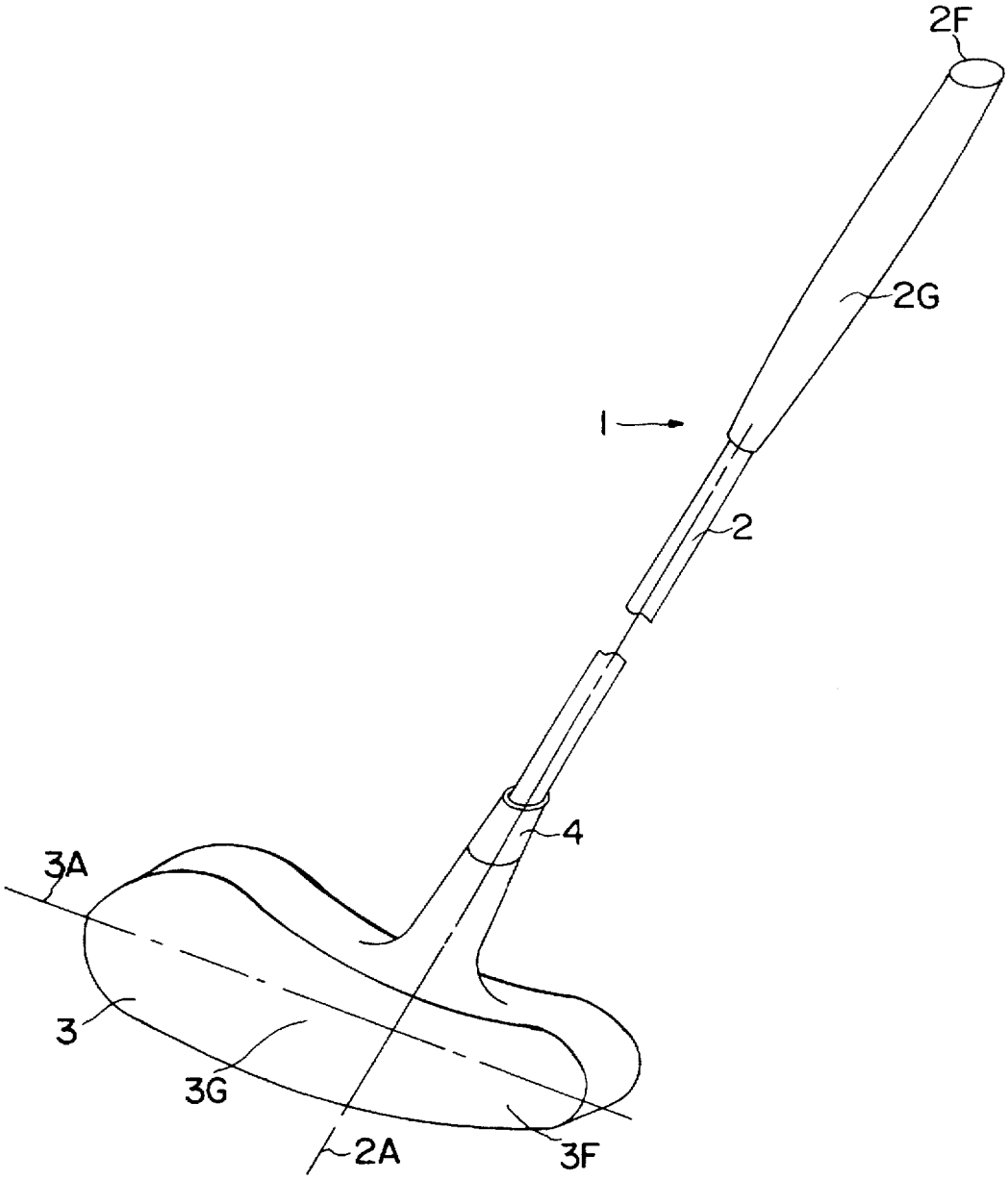
FIG. 1 PRIOR ART
FIG. 1 is a perspective view of a prior art golf putter.
Figure 2:
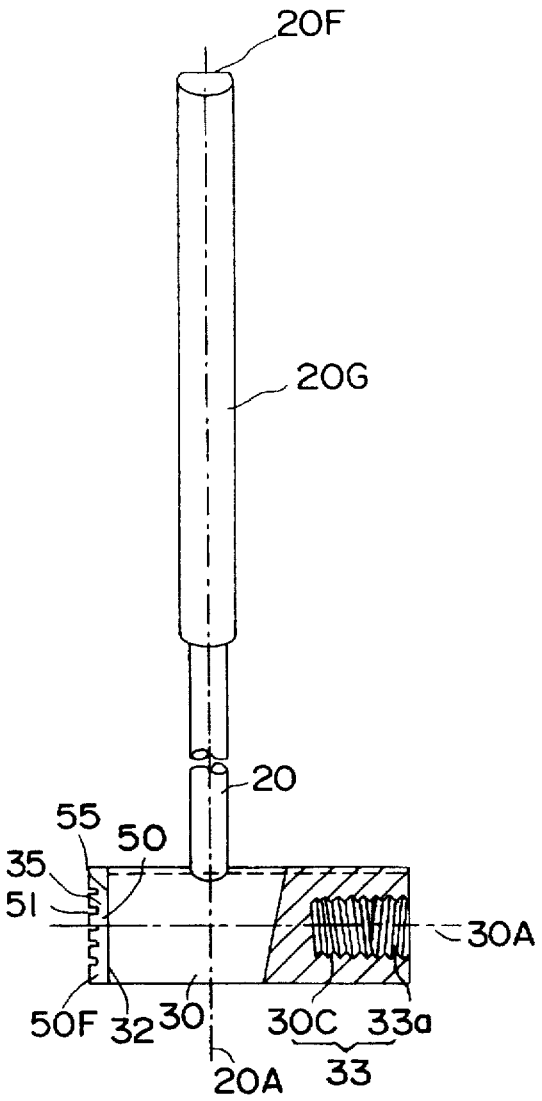
FIG. 2 is a front view of a golf putter in accordance with a preferred embodiment of the present invention.
Figure 3:
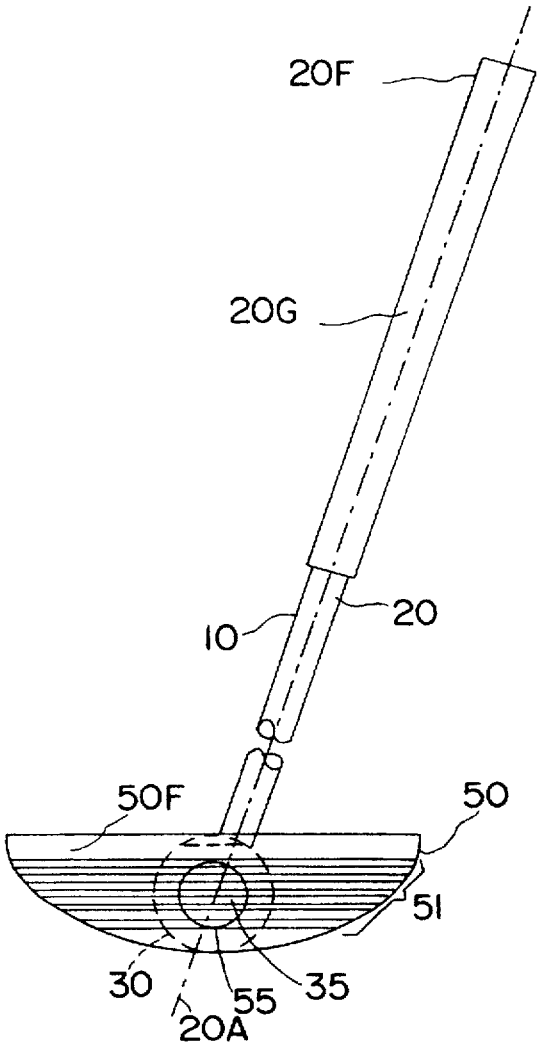
FIG. 3 is a leftside view of the golf putter in FIG. 2.
Figure 4:
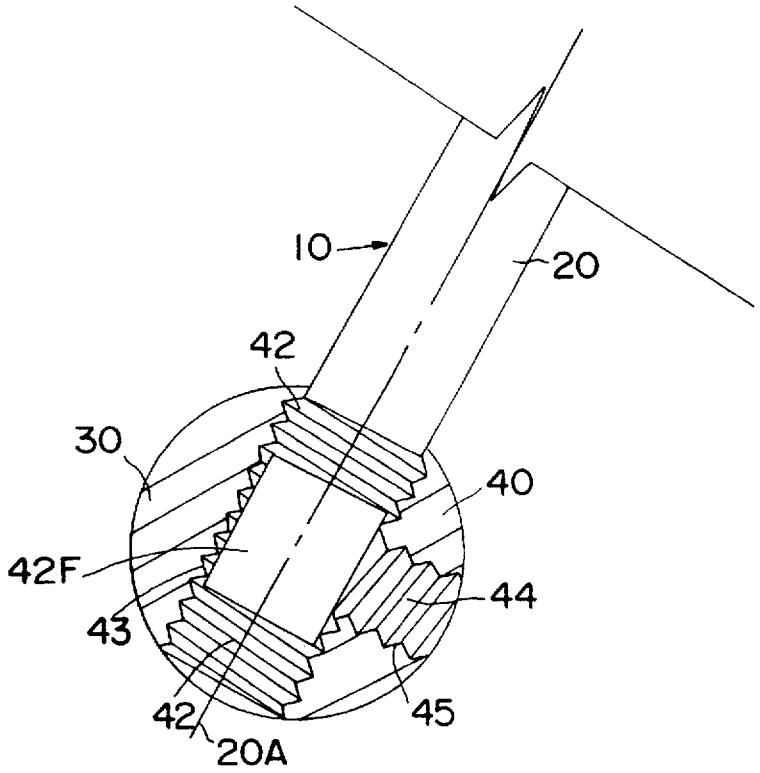
FIG. 4 is a partial, cross-sectional view showing a connecting means of the golf putter in FIG. 2.

As shown in FIGS. 2, 3 and 4, a golf putter 10 in accordance with a preferred embodiment of the present invention generally comprises a shaft 20, an elongated, cylindrically shaped head 30 being perpendicularly connected to a bottom end of the shaft 20 and a connecting means 40 for connecting the shaft 20 and head 30.

The shaft 20 has its upper end mounted with a grip 20G having a base face 20F and its lower portion formed with a threaded portion 42, respectively.

The head 30 is of a regular and symmetrical shape and is diametrically formed with a first thread hole 43 for thread engagement with the threaded portion 42. The head 30 has a stretched semicircular shaped impact face 50F formed on a surface of an impact wing 50 provided on a longitudinal end of the head 30 and counterweight adjust means 33 is provided on the other end thereof. The counterweight adjust means 33 is comprised of a threaded bore 30C formed on the end of the head 30 and a threaded counterweight 33*a* movably engaged within the threaded bore 30C, whereby an optimal position within the bore 30C for the counterweight 33*a* is obtainable by using any appropriate tool, such as a screw driver or even a key, to adjust an exposed adjusting slot (not shown) formed at a distal end of the counterweight 33*a* in accordance with individual preference. As the shaft 20 is adapted to be connected to the head 30 by the thread engagement of the threaded portion 42 with the first thread hole 43, the longitudinal axis 20A of the shaft 20 thus passes through the gravity center of the head 30 and vertically crosses with a lateral axis 30A of the head 30 whereby there exists no inertia moment with respect to the shaft 20 when in putting. In addition, a second thread hole 45 is formed in the head 30 and is also positioned perpendicular to the lateral axis 30A of the head 30. The second thread hole 45 allows a threaded bolt 44 to be screwed thereinto so as to firmly secure the shaft 20 the head 30. Altogether the threaded portion 42, first thread hole 43, second thread hole 45, and threaded bolt 44 are formed into the connecting means 40.

When either the shaft 20 or the head 30 needs to be replaced, it only has to unscrew the threaded bolt 44 until the threaded bolt 44 is not in contact with the threaded portion 42 and then unscrew the threaded portion 42 from the first thread hole 43 to disengage the shaft 20 and the head 30. Similarly, when a golfer needs to adjust the length of the portion of the shaft 20 exposing out of the head 30 in terms of his/her height, he/she may just unscrew the threaded bolt 44 until the threaded bolt 44 is not in contact with the threaded portion 42, and then unscrew the threaded portion 42 upwardly to make the portion of the threaded portion 42 received within the first thread hole 43 shorter and at the same time the portion of the shaft 20 exposing out of the head 30 longer, or screw the threaded portion 42 downwardly to make the portion of the threaded portion 42 received within the first thread hole 43 longer and at the same time the portion of the shaft 20 exposing out of the head 30 shorter. In the same manner, the position of the head 30 with respect to the shaft 20 can be adjusted so as to maintain the base face 20F of the grip 20G and the impact face 50F of the head 30 in perpendicular relationship.

Figure 5:
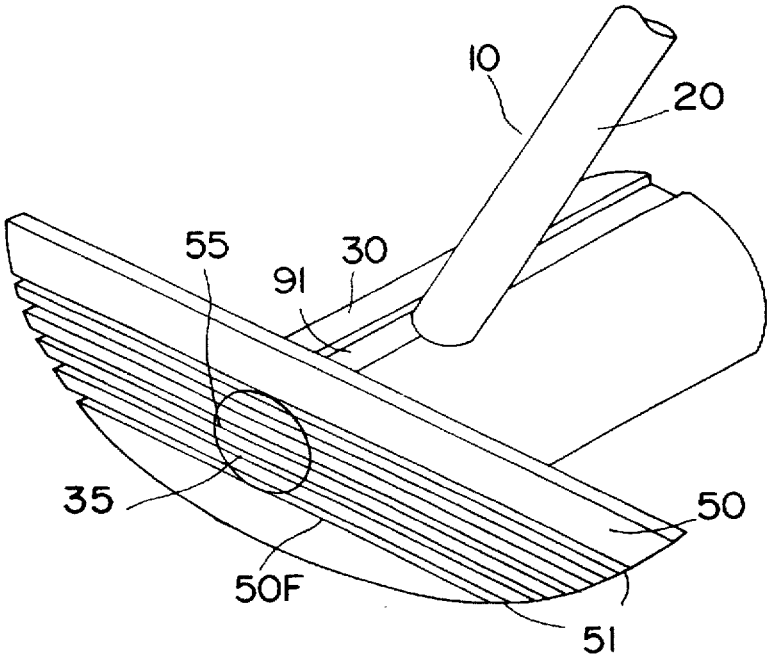
FIG. 5 is a partial, enlarged perspective view of the golf putter in FIG. 2

Furthermore, as shown in FIG. 5, a lengthwise sight 31 is formed on the top of the head 30. By the lengthwise sight 31, a golfer is able to aim at the hole on a putting green more easily and thus to control the putting direction more precisely.

Friction stripes 51, may be further formed on the impact face 50F so as to provide for an instant a friction force incurred between a ball and the impact face 50F while putting the ball with the impact face 50F. By the incurrence of the friction force, the ball can be putted toward a predetermined direction without deflection of the running course of the ball caused by a frictionless contact between the ball and the impact face.

Additionally, the provision of the impact wing to the end of the head is preferably by means of a projection 35 formed on the end of the head 30 and a receiving hole 55 formed on the impact wing 50 for fixedly attachment with the projection 35. In this way, the impact force occurred upon the impact face 50F can thus be transmitted directly to the gravity center of the head 30 through the projection 35 of the head 30.

Several prototypes of the golf putter in accordance with the above embodiment of the present invention have been tested a great number of times on putting greens in different golf courses. The result shows that an average deviation distance from the putted ball to the hole is merely 2 to 3 feet when putting the ball at a position of more than 20 feet away from the hole. Under the same condition, an average deviation distance from a ball to the hole is 6 to 8 feet when using a prior art golf putter to putt the ball. The above result shows that the golf putter of the present invention considerably improves in putting accuracy over conventional golf putters.

Although the contemplated embodiments of the present invention has been described, it is to be understood that may modifications may be made by persons skilled in the art without departing from the scope of the appended claims.

What is claimed is:

1. A golf putter comprising:

a shaft;

an elongate head connected to said shaft and having an impact face formed on a surface of an impact wing provided on a longitudinal end of said head;

a counterweight position adjustment means provided in another longitudinal end of said head; and a connecting means connecting said shaft and head, said connecting means comprising:

a threaded portion formed on a bottom end of said shaft;

a first threaded hole diametrically formed in said head, which passes through a center of gravity of said head, for threaded engagement with said threaded portion a second threaded hole formed in said head in a position perpendicular to said first threaded hole and a threaded bolt for threaded engagement with said second threaded hole, whereby said threaded portion is secured to said first threaded hole by said threaded bolt.

2. The golf putter as claimed in claim 1, wherein said head is shaped symmetrically with respect to a longitudinal axis of said shaft.

3. The golf putter as claimed in claim 1, wherein said shaft is provided with a grip at a top end thereof.

4. The golf putter as claimed in claim 1, wherein said impact face is further provided with friction means for providing for an instant friction force to occur between a ball and said impact force when putting the ball.

5. The golf putter as claimed in claim 4, wherein said friction means comprises a plurality of friction strips formed on said impact face.

6. The golf putter as claimed in claim 1, wherein lengthwise sight is further provided on a top surface of said head.

7. The golf putter as claim in claim 1, wherein said impact wing is coupled to said head by means of a projection formed on end of said head and a receiving hole formed in said impact wing for fixedly attachment with said projection.

8. The golf putter as claimed in claim 1, wherein said impact face is positioned in a perpendicular relationship with a lateral axis of said head.

9. The golf putter as claimed in claim 1, wherein said counterweight adjustment means comprises a threaded bore formed in the end of said head and a threaded counterweight movably engaged within said threaded bore.

* * * * *